US009731212B2

(12) United States Patent
Cheung

(10) Patent No.: US 9,731,212 B2
(45) Date of Patent: Aug. 15, 2017

(54) TOY TRACK SYSTEM AND A TOY VEHICLE FOR MOVING THEREIN

(71) Applicant: Ever Victory Technology Limited, Kowloon (HK)

(72) Inventor: Kwong Ming Cheung, Kowloon (HK)

(73) Assignee: EVER VICTORY TECHNOLOGY LIMITED, Hong Kong (HK)

( * ) Notice: Subject to any disclaimer, the term of this patent is extended or adjusted under 35 U.S.C. 154(b) by 0 days.

(21) Appl. No.: 14/955,685

(22) Filed: Dec. 1, 2015

(65) Prior Publication Data

US 2016/0220915 A1 Aug. 4, 2016

(30) Foreign Application Priority Data

Feb. 2, 2015 (HK) ..... 15101111.5

(51) Int. Cl.

| | |
|---|---|
| ***A63H 18/02*** | (2006.01) |
| ***A63H 17/00*** | (2006.01) |
| ***A63H 17/26*** | (2006.01) |

(52) U.S. Cl.

CPC ..... *A63H 18/02* (2013.01); *A63H 17/262* (2013.01); *A63H 18/028* (2013.01)

(58) Field of Classification Search

CPC ..... A63H 18/00; A63H 18/02; B61B 13/00
See application file for complete search history.

(56) References Cited

U.S. PATENT DOCUMENTS

| | | | | | |
|---|---|---|---|---|---|
| 3,069,805 | A * | 12/1962 | Burrows | A63F 7/042 | 273/153 R |
| 3,752,472 | A * | 8/1973 | Snead | A63B 9/00 | 482/35 |
| 4,080,752 | A * | 3/1978 | Burge | A63H 33/042 | 285/179 |
| 4,162,106 | A | 7/1979 | Lawrence et al. | | |
| 4,231,294 | A * | 11/1980 | Arzoumanian | A63H 19/10 | 104/138.1 |

(Continued)

OTHER PUBLICATIONS

Search Report dated Nov. 13, 2015 for Hong Kong Short-Term Patent Application, State Intellectual Property Office of the Peoples Republic of China, Application No. 15101111.5, six (6) pages total.

*Primary Examiner* — John Ricci
(74) *Attorney, Agent, or Firm* — Ware, Fressola, Maguire & Barber LLP

(57) ABSTRACT

A toy track system for a toy car to move therein and along having a plurality of tube sections including at least first and second tube sections which are connectable endwise together to form part of the toy track system; and a connection module comprising: coupling means having first and second coupling parts which are provided on the first and second tube sections respectively and are inter-engageable with each other to prevent axial separation between the first and second tube sections; and interlocking means having first and second interlocking parts which are provided on the first and second tube sections respectively and are inter-engageable with each other to fix the first and second tube sections in one predetermined angular position relative to each other selected from at least two predetermined angular positions. The car has a wheel, a motor, gears, a presser, principal guiding members and auxiliary guiding members.

20 Claims, 6 Drawing Sheets

(56) References Cited

U.S. PATENT DOCUMENTS

| | | | | | |
|---|---|---|---|---|---|
| 4,838,170 | A * | 6/1989 | Illakowicz | B61C 13/00 | 104/138.2 |
| 5,142,989 | A * | 9/1992 | Suzumori | G21C 17/017 | 104/138.2 |
| 5,507,679 | A * | 4/1996 | Getsay | A63H 21/02 | 104/119 |
| 5,971,404 | A * | 10/1999 | Stoves | F16L 55/28 | 104/138.2 |
| 6,123,027 | A * | 9/2000 | Suyama | F16L 55/28 | 104/138.2 |
| 7,188,568 | B2 * | 3/2007 | Stout | F16L 55/32 | 104/138.2 |
| 2005/0266768 | A1 * | 12/2005 | Bailey | A63H 17/14 | 446/427 |
| 2008/0245258 | A1 * | 10/2008 | Herron | F16L 55/32 | 104/138.2 |

* cited by examiner

101

1022
1024
1023
101
2
1:1.5 x,y
105
101
1021
104
A
B
1031/1032
A
1024
104
1022
1021A/1021B
101
x,y
B 1023
101
1022
B
A
101

101
101

TOY TRACK SYSTEM AND A TOY VEHICLE FOR MOVING THEREIN

The present invention relates to a toy track system and a toy vehicle for moving therein, for example particularly, but not exclusively, a toy track system suitable for a self-propelling toy vehicle for moving therein.

BACKGROUND OF THE INVENTION

Toy track system and toy vehicles are widely available to help children develop their motor skills.

Many track systems are open top track systems where toy vehicles, especially those travelling at relatively high speed can easily fall out or shoot off. Toy cars shooting off at a high speed can be hazardous.

Conventional track system comes in set. Players can build their own track systems. However the track systems have specific configurations which are limited to, for example one or two configurations, by the components provided in set. There is no promotion of creativity.

The invention seeks to eliminate or at least to mitigate such shortcomings for more fun by providing a new or otherwise improved toy track system and toy vehicle.

SUMMARY OF THE INVENTION

According to the invention, there is provided a toy track system for a toy car to move therein and along, comprising a plurality of tube sections including at least first and second tube sections which are connectable endwise together to form part of the toy track system; and a connection module comprising:

coupling means having first and second coupling parts which are provided on the first and second tube sections respectively and are inter-engageable with each other to prevent axial separation between the first and second tube sections; and interlocking means having first and second interlocking parts which are provided on the first and second tube sections respectively and are inter-engageable with each other to fix the first and second tube sections in one predetermined angular position relative to each other selected from at least two predetermined angular positions.

Preferably, the connection module includes first and second sleeves on which any of the first and second coupling parts are supported respectively.

More preferably, the first and second sleeves are provided at one end of the first and second tube sections respectively at which they are connectable endwise.

Advantageously, the first sleeve is insertable into the second sleeve for inter-engagement of the first and second coupling parts to prevent axial separation between the first and second tube sections.

More advantageously, the coupling means includes a flexing member on one of the first and second sleeve for assisting insertion of the first sleeve into the second sleeve.

Preferably, the connection module includes a third sleeve on which there is provided corresponding first and second coupling parts for inter-engaging the first and second coupling parts on the first and second sleeve.

More preferably, the coupling means includes a flexing member on the first and second or the third sleeve for assisting inter-engagement of corresponding first and second coupling parts.

It is preferable that the first and second sleeves are insertable into the third sleeve for inter-engagement of the first and second coupling parts.

It is advantageous that the coupling means includes a flexing member on the third sleeve for assisting insertion of the first and second sleeve into the third sleeve.

Preferably the flexing member comprises a pair of separated plates.

More preferably the plates are separated by a slot or a slit.

Yet more preferably, the first coupling part has a first surface operable to abut a first surface of the second coupling part when the first and second coupling parts inter-engage to thereby prevent the axial separation between the first and second tube sections.

Advantageously the first coupling part has a second surface operable to abut a second surface of the second coupling part, the second surfaces form the first and second interlocking parts of the interlocking means to fix the first and second tube sections in one predetermined angular position relative to each other selected from at least two predetermined angular positions.

More advantageously, the first and second surfaces are arranged orthogonal to one another.

Yet more advantageously, the first coupling part comprises a projection and the second coupling part comprises a recess or opening dimensioned to receive the projection.

In another aspect of the invention there is provided a toy vehicle for moving in and along a toy track system having a longitudinal central plane including a longitudinal central axis, comprising a vehicle body having opposite first and second end portions and opposite first and second sides; a driving wheel provided at the first end portion on the first side of the vehicle body for frictional engagement with an inner surface of said track system to move the vehicle body; an electric motor provided in the vehicle body for rotating the driving wheel; gears provided in the vehicle body for transmitting drive from the electric motor to the driving wheel for rotating the driving wheel; a presser mounted at the first end portion on the second side of the vehicle body and resiliently biased in a direction directly opposite and away from the driving wheel for bearing against said inner surface to maintain said frictional engagement of the driving wheel; at least two principal guiding members provided on the first end portion of the vehicle body, the principal guiding members being angular displaced from the driving wheel and the presser for maintaining the driving wheel substantially in a said central plane when the toy vehicle moves along the toy track system; at least three auxiliary guiding members provided on the second end portion of the vehicle body and angularly displaced from the principal guiding members for maintaining the driving wheel substantially in a said central plane when the toy vehicle moves along the toy track system.

Preferably, the principal guiding members are arranged opposite one another.

More preferably, the principal guiding members are arranged on a first plane which extends perpendicular to a second plane on which the driving wheel and the presser are arranged.

Yet more preferably, the at least three auxiliary guiding member are equally spaced apart from each other and are arranged on respective planes angularly displaced from the first and second planes.

Advantageously, the second end portion of the vehicle body is provided with four auxiliary guiding members angularly displaced from the principal guiding members for maintaining the driving wheel substantially in a said central plane when the toy vehicle moves along the toy track system.

More advantageously, the four auxiliary guiding members are arranged on different planes which are arranged substantially perpendicular to one another and are evenly angularly displaced from the first and second planes.

Yet more advantageously, the auxiliary guiding members are radially displaced from the driving wheel such that the auxiliary guiding members are relatively closer to the vehicle body than the driving wheel.

Preferably, the principal and auxiliary guiding members comprise wheels.

More preferably, the vehicle body includes a battery mounted therein.

Advantageously, the battery is a rechargeable battery.

In a further aspect of the invention there is provided a toy kit comprising the toy track system and the toy vehicle as disclosed above.

BRIEF DESCRIPTION OF DRAWINGS

The invention will now be more particularly described, by way of example only, with reference to the accompanying drawings, in which.

DETAILED DESCRIPTION

Figures 1A, 1B, 1C, 1D, 1E:
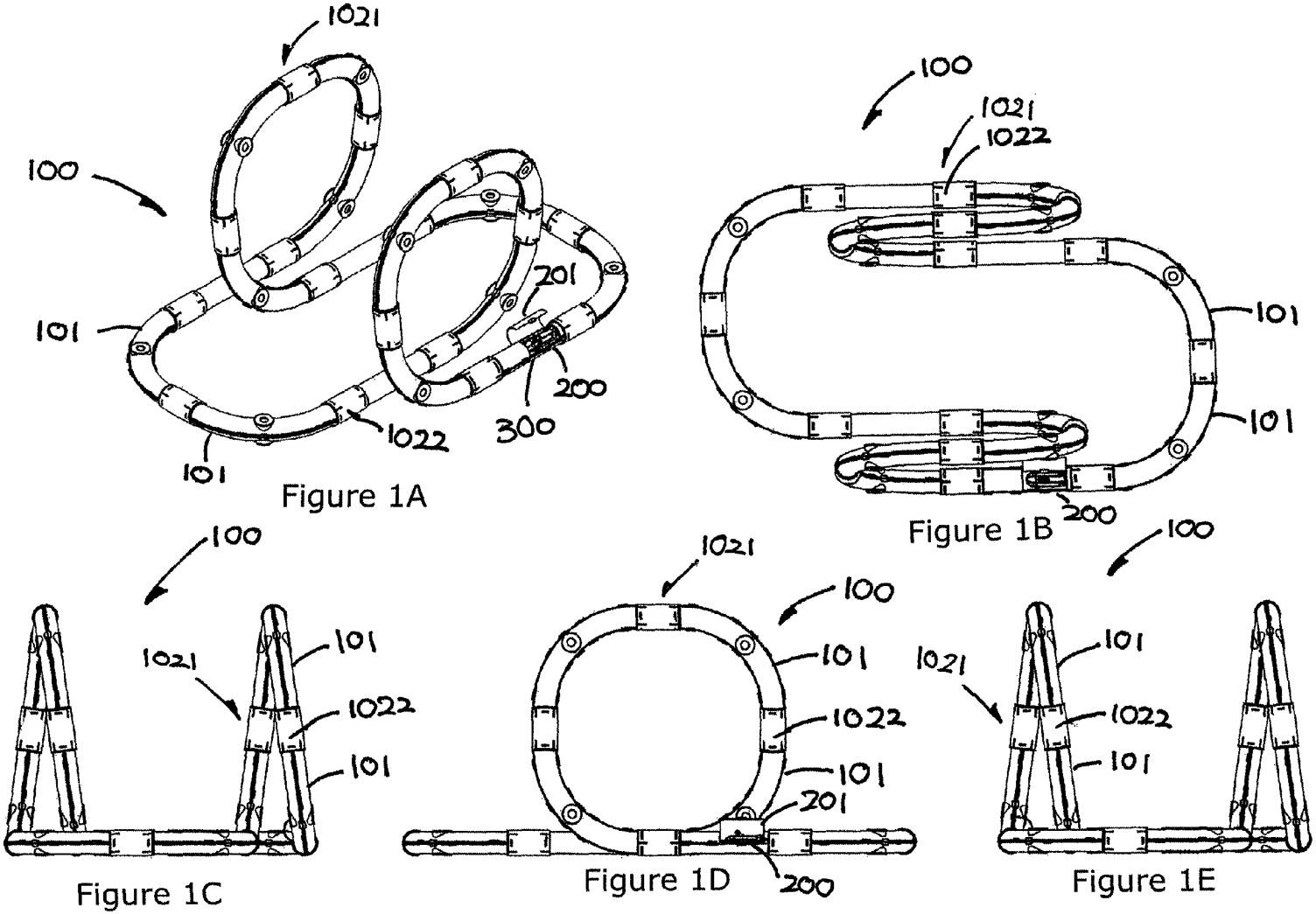
FIGS. 1A to 1E are perspective view, top plan view, left side view, front view and right side view of a toy track system in a first arrangement according to the invention.
Figures 2A, 2B, 2C, 2D, 2E:
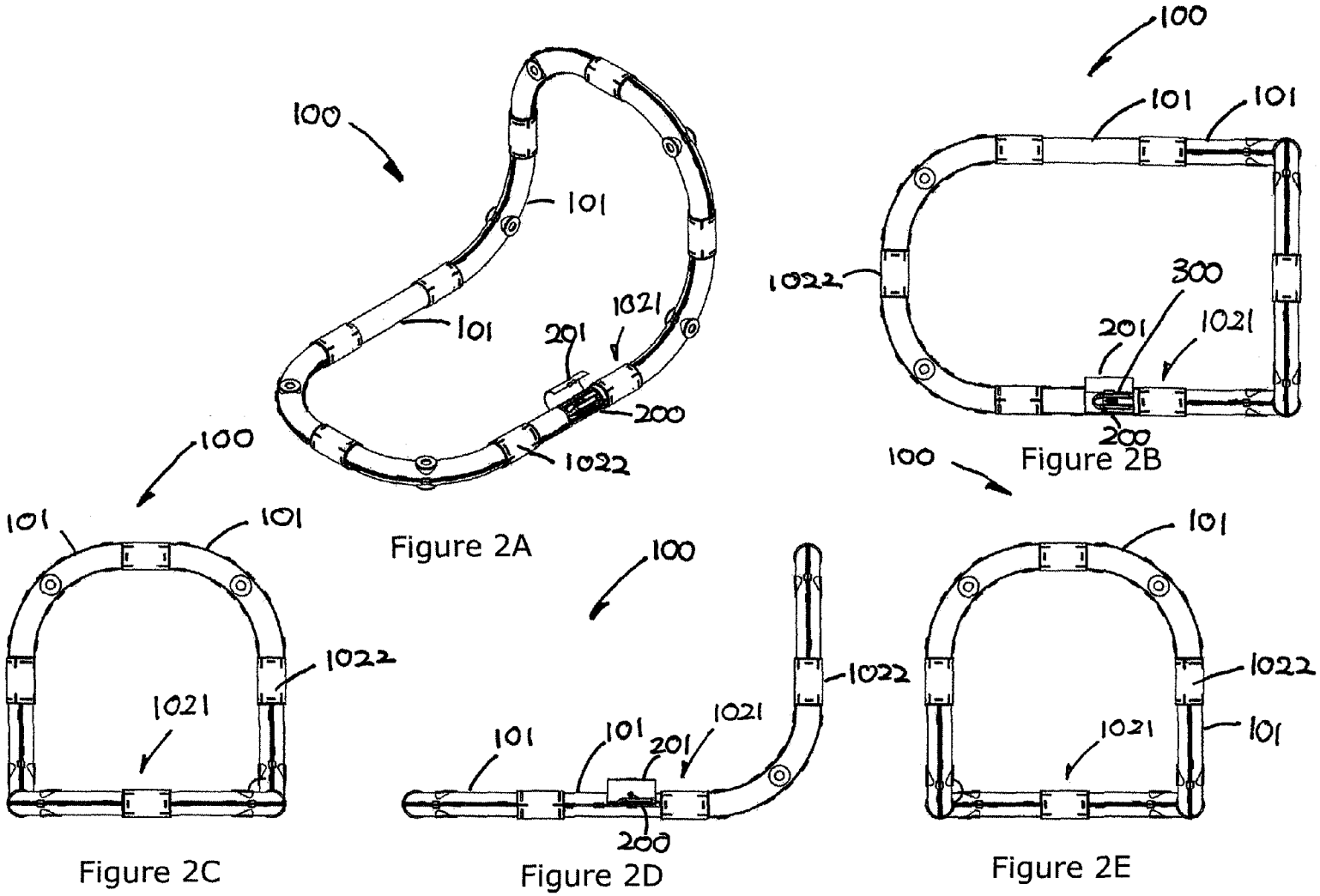
FIG. 2A to 2E are perspective view, top plan view, left side view, front view and right side view of the toy track system in FIGS. 1A to 1E in a second arrangement.
Figures 3A, 3B, 3C, 3D, 3E:
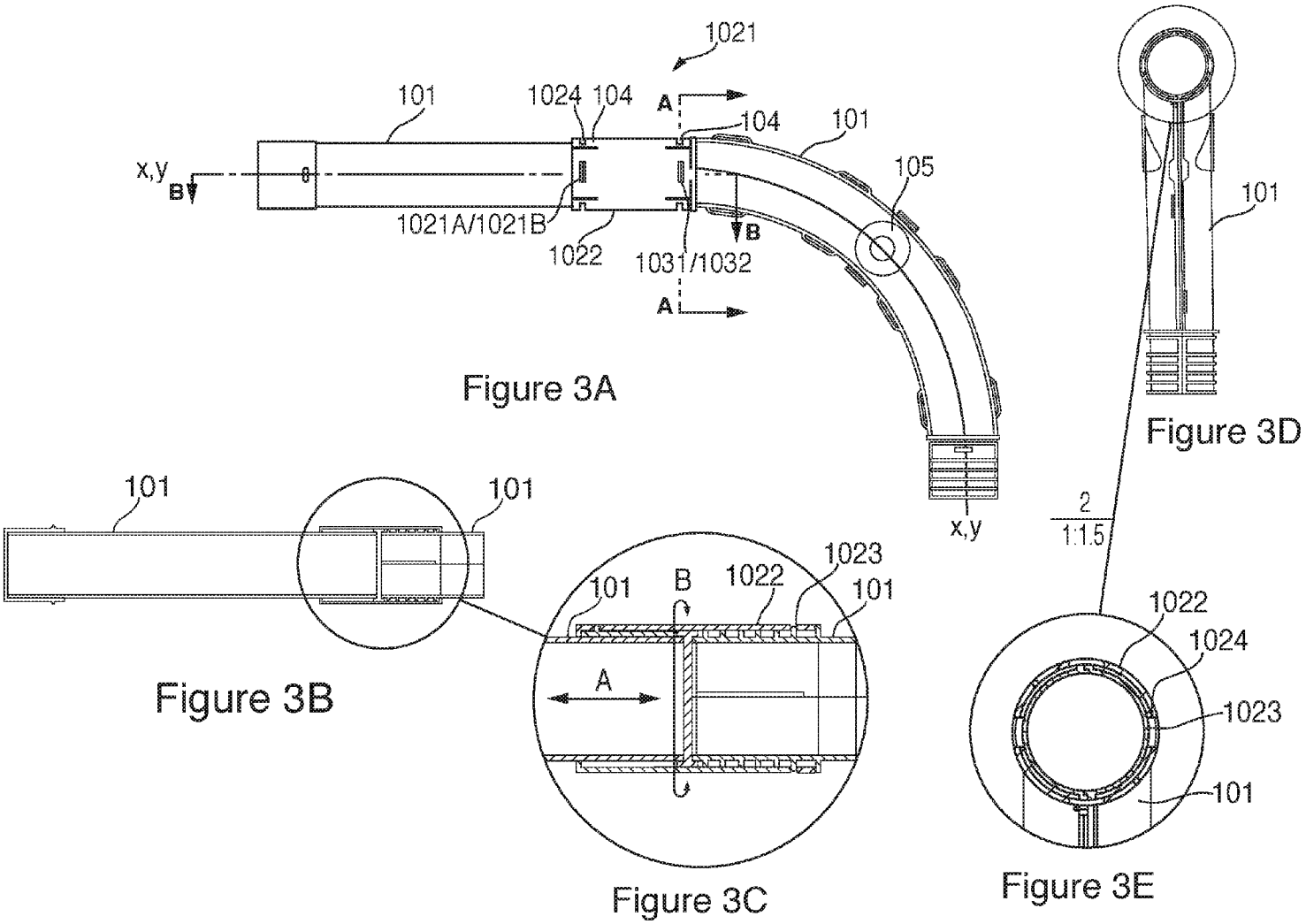
FIG. 3A is a top plan view of a first and second tube sections and a connection module provided there between of the toy track system in FIGS. 1A to 2E.
FIG. 3B is a cross-sectional view of the first tube section and the connection module in FIG. 3A taken along line B-B in FIG. 3A.
FIG. 3C is an enlarged cross-sectional view of the connection module in FIG. 3B.
FIG. 3D is a side view of the second tube section in FIG. 3A and a cross-sectional view of the connection module in FIG. 3A taken along line A-A.
FIG. 3E is an enlarged cross-sectional view of the connection module in FIG. 3D.

Referring to FIGS. 1A to 2E of the drawings, there is shown a toy track system 100 in two different arrangements. The toy track system 100 is designed for or suitable for a toy car 300 to move therein and along. Each toy track system 100 includes a plurality of tube sections 101 and a connection module 102. Two tube sections 101 can be removably connected together endwise by the connection module 102 to form a part of the toy track system 100 as shown in FIGS. 3A to 3E. In the preferred embodiment, the toy track system 100 is an endless continuous track system.

As shown in FIGS. 1A, 1B, 1D, 2A, 2B and 2D, the toy track system 100 is openable by way of an opening 200, preferably covered by a door 201, for placing the toy car 300 therein. The door 201 is hingedly connected to a side of the opening 200 such that the door 201 can pivot between open and closed positions. At the closed position, the door 201 is preferably securely locked to the side of the opening to permit the toy car 300 to run smoothly across.

The connection module 102 has a coupling means 1021. In a first embodiment which is not shown in the drawings, the coupling means 1021 includes a first and second coupling parts 1021A and 1021B provided at one of the free ends of each of first and second tube sections 101. These first and second coupling parts 1021A and 1021B are with corresponding coupling configurations inter-engageable with each other to prevent axial separation between the tube sections 101. The two tube sections 101 are connected end-to-end and the first and second coupling parts 1021A and 1021B are a pair of corresponding coupling parts. The other free ends of the tube sections 101 may be provided with further first or second coupling parts 1021A and 1021B so that they may be connected to other tube sections 101 with corresponding coupling parts 1021A and 1021B. The toy track system 100 is made up of a plurality of such tube sections 101 connected to each other by the coupling means 1021. Preferably, the free ends of the tube sections 101 include respective sleeves on which the coupling parts 1021A and 1021B are provided. The sleeve may be the end portion of the tube section 101 or a separate portion coupled or integrally formed with the rest of the tube section 101.

In a second, alternative embodiment as shown in the drawings, the two tube sections 101 are connected through a collar in the form of a sleeve 1022 which forms part of the connection module 102. The collar 1022 has two free ends each equipped with first and/or second coupling parts 1021A and 1021B. In a preferred embodiment, the free ends of the collar 1022 may be coupled to or integrally formed with respective sleeves on which the first and/or second coupling parts 1021A, 1021B are provided. A free end of each tube section 101 is provided with a corresponding first or second coupling parts 1021A or 1021B for inter-engagement with the coupling parts 1021A or 1021B on the collar 1022. The collar 1022 acts as a bridge between the two tube sections 101. The other free ends of the tube sections 101 may include further coupling parts 1021A and 1021B for coupling with other tube sections 101 directly or through another collar 1022. Again, the tube sections 101 may include sleeves on which the coupling parts 1021A and 1021B are provided.

In the preferred embodiment, the sleeve on which the first coupling part 1021A is provided is slidable/insertable into the sleeve on which the second coupling part 1021B is provided to bring about the inter-engagement between the first and second coupling parts 1021A and 1021B. In other words, the one of the sleeves on which the first coupling part 1021A has a small diameter than that of sleeve on which the second coupling part 1021B is provided. The difference permits insertion and allows inter-engagement between the first and second coupling parts 1021A and 1021B which prevents axial separation between the first and second tube sections 101. The sleeves have to be of some degree of resilience in order to press the first and second coupling parts 1021A and 1021B together for inter-engagement when they are slide into place.

It is possible for one tube section 101 to have both types of coupling parts 1021A and 1021B on respective ends.

Alternatively, both ends of the tube section 101 may be equipped with the same type of coupling parts 1021A or 1021B.

In addition to the coupling parts 1021A and 1021B, the connection module 102 also includes interlocking means 103 having first and second interlocking parts 1031 and 1032. The first and second interlocking parts 1031 and 1032 are provided on the tube sections 101 or preferably the sleeves of the tube sections 101 and are inter-engageable with each other to fix the tube sections 101 in one predetermined angular position relative to each other selected from at least two predetermined angular positions.

In the first embodiment where the tube sections 101 are coupled end-to-end, the first interlocking parts 1031 are provided on the free end or sleeve of the tube section 101 adjacent or between the coupling parts 1021A or 1021B. The second interlocking parts 1032 are provided on the free end or sleeve of the other tube section 101 adjacent or between the coupling parts 1021A or 1021B.

In the second embodiment where the tube sections 101 are coupled through a collar or sleeve 1022, the first and second interlocking parts 1031 and 1032 are provided at both free ends or sleeves of the collar or sleeve 1022. These interlocking parts 1031 and 1032 are provided adjacent or between the coupling parts 1021A or 1021B.

These interlocking parts 1031 and 1032 form part of the coupling parts 1021A and 1021B. In the preferred embodiment, the coupling part 1021A is a first surface of a projection or protrusion 1023, the coupling part 1021B is a first surface of a recess or opening 1024. The first surfaces abut one another preventing axial separation between the two tube sections 101. The first interlocking part 1031 is preferably a second surface of the projection or protrusion 1023, the second interlocking part 1032 is preferably a second surface of the recess or opening 1024. The second surfaces abut one another to fix the first and second tube sections in one predetermined angular position relative to each other. The first and second surfaces are arranged at right angle to one another in the specific embodiment.

The first surface of the projection or protrusion 1023 may include a pair of opposite first surfaces. The first surface of the recess or opening 1024 may also include a pair of opposite first surfaces that abut the first surfaces of the projection or protrusion 1023 respectively to prevent axial separation between two tube sections 101 in two opposite directions A.

The second surface of the projection or protrusion 1023 may include a pair of opposite second surfaces. The second surface of the recess or opening 1024 may also include a pair of opposite second surfaces that abut the second surfaces of the projection or protrusion 1023 respectively to lock the tube sections 101 in a predetermined angular position. This is made possible by preventing relative sliding of the tube sections 101 in two opposite directions B which is on a plane perpendicular to that of the directions A.

There are preferably more than one pair of coupling parts 1021A, 1021B and interlocking parts 1031, 1032 evenly distributed on the respective free ends or sleeves. Preferably there are four pairs of coupling parts 1021A, 1021B and interlocking parts 1031, 1032 arranged at 90 degree to each other.

The tube sections 101 are not necessarily a straight tube but may be of different configurations, the relative rotation of the tube sections 101 allow the selection of the relative angular orientations of two tube sections 101. The interlocking parts 1031 and 1032 allow the selection of a preferred or predetermined angular position of the two tube sections 101 from at least two predetermined angular positions which are defined by the positions of the interlocking parts 1031 and 1032 on the free ends or sleeves.

Preferably, on one of the free end or sleeves there is provided a flexing member 104. The coupling parts 1021A or 1021B as well as the interlocking parts 1031 and 1032 are preferably provided on the flexing member 104. The flexing member 104 includes at least one pair of separated plates. These plates are preferably separated by a slot or a slit. Alternatively, the flexing member 104 may be plates connected by a flexible web. The flexing member 104 allow the first coupling part 1021A and the corresponding sleeve on one tube section 101 to be inserted into the second coupling part 1021B and the corresponding sleeve on another tube section 101 or on the collar 1022.

In the first embodiment, the flexing member 104 is provided with one of the free ends or sleeve of one of the tube sections 101. In the second embodiment, the flexing member 104 is on the free ends or sleeves of the collar 1022. The flexing member 104 allows the sleeve to deform or expand temporarily for permitting the projections to slide into the recess or opening 1024.

In the most preferred embodiment, on each of the tube section 101 there is provided coupling parts 1021A in the form of four projections 1023. The projections 1023 are evenly distributed on the sleeve which is integrally formed with the end portion of the tube section 101. A collar 1022 is employed to connect the tube sections 101.

The collar 1022 has two opposite free ends each equipped with a sleeve on which coupling parts 1021B in the form of four openings 1024 are evenly distributed around. Each of the openings 1024 are dimensioned and shaped to accommodate one of the projections 1023. The number of openings 1024 is the same as the number of projections 1023. This is not necessarily the case where more openings are provided to allow more angular positions to be selected. In the preferred embodiment, the openings 1024 are rectangular in shape with four sides abutting four sizes of the rectangular projections 1023. The sleeves on the tube sections 101 are inserted into the respective free ends of the collar 1022. Each sleeve of the collar 1022 has four flexing members 104 evenly distributed around and separated by respective slots. The slots allow the flexing members 104 to move away from each other such that the projections 1023 and the corresponding sleeve can push through the sleeves on the collar 1022 and are eventually accommodated in the respective openings 1024 on the collar 1022.

A projection 1023 and an opening 1024 forms a pair of coupling parts 1021A and 1021B and a pair of interlocking parts 1031 and 1032. More specifically, two longer sides of one projection 1023 abut the corresponding two longer sides of the opening 1024 to prevent axial movement between the collar 1022 and the tube section 101 in the direction A. The two shorter sides of the one projection 1023 abut the corresponding shorter sides of the opening 1024 to prevent angular movement of the tube section 101 relative to the collar 1022 along the direction B. The same applies to the other tube section 101 that connects to the other sleeve of the collar 1022.

By forcing the projection 1023 out of the opening 1024, the angular movement and axial movement of the tube section 101 relative to the collar 1022 and hence the other tube section 101 are permitted. Selection of the preferred angular orientation of the tube sections 101 may be performed accordingly. This would involve rotating the projection 1023 out of the opening 1024 and to fit the projection 1023 into another opening 1024 on the same sleeve.

In another embodiment, the coupling part 1021A may be in the form of a groove and the coupling part 1021B may be in the form of projections extending from the corresponding sleeve. The interlocking parts 1031 and 1032 may involve a stopper insertable into various openings on the sleeves.

As can be seen from the drawings, the tube sessions 101 have one or more supports 105 along length. The tube sessions 101 are supported on a flat surface by the support 105.

Figure 4B:
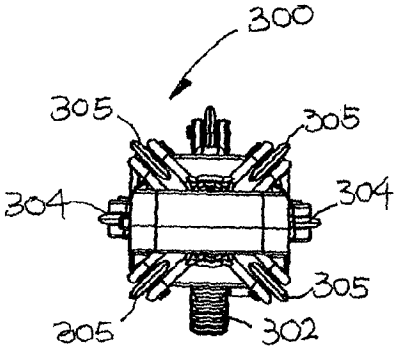
FIGS. 4A to 4D are side view, rear view, front view and top plan view of a toy vehicle according to the invention.
Figure 4D:
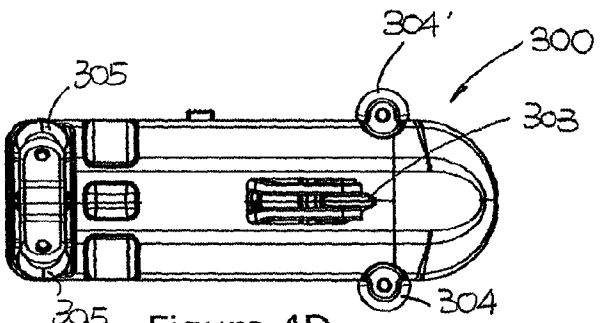
Figure 4A:
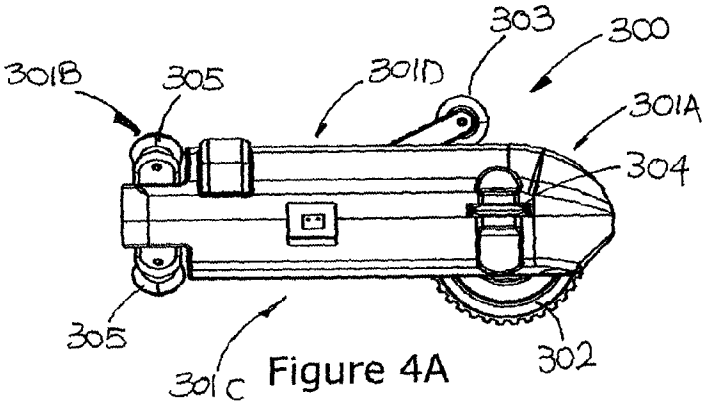
Figure 4C:
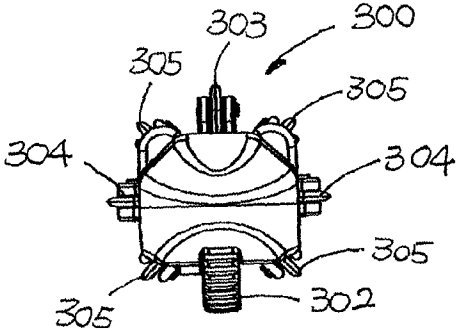
Figure 5A:
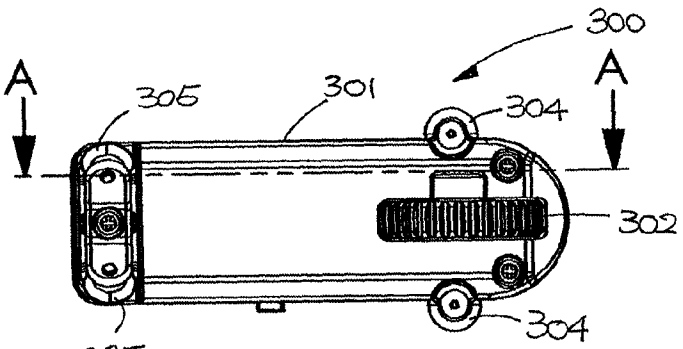
FIG. 5A is a bottom plan view of the toy vehicle in FIGS. 4A to 4D.
Figure 5B:
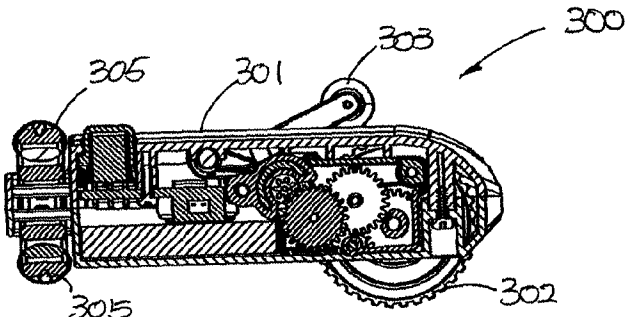
FIG. 5B is a cross-sectional view of the toy vehicle in FIG. 5A taken along line A-A.
Figure 6B:
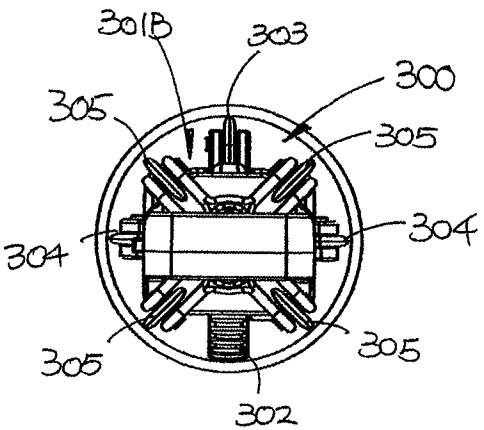
FIGS. 6A and 6B are cross-sectional views of the first tube section in FIG. 3A taken along width showing the respective front and rear views of the toy vehicle in FIGS. 4A to 4D inside the toy track system in FIGS. 1A to 3E.
Figure 6A:
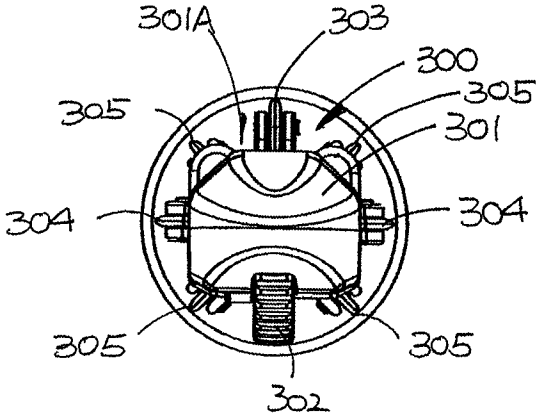

In a further aspect of the invention there is provided a toy vehicle 300 in the form of a car. We now refer to FIGS. 4A to 6B. The toy vehicle 300 is designed for or suitable for moving in and along the toy track system 100. The toy track system 100 has a longitudinal central plane X including a longitudinal central axis Y (see FIG. 3A).

The toy vehicle 300 includes a vehicle body 301 with opposite first and second end portions, more specifically the head and tail portions 301A, 301B and opposite first and second sides, more specifically the bottom and top sides 301C, 301D spanning across the first and second end portions 301A and 301B. There is also a driving wheel 302 provided at the head portion 301A on the first side 301C of the vehicle body 301 for frictional engagement with an inner surface of said track system 100 to move the vehicle body 301. An electric motor is mounted in the vehicle body 301 for rotating the driving wheel 302 and gears are provided in the vehicle body 301 for transmitting drive from the electric motor to the driving wheel 302 for rotating the driving wheel 302. A presser 303 mounted at the front portion 301A extending beyond the top side 301D of the vehicle body 301. This presser 303 is resiliently biased, preferably by action of a spring, in a direction directly opposite and away from the driving wheel 302 for bearing against said inner surface to maintain said frictional engagement of the driving wheel 302. In the preferred embodiment, the presser 303 includes an arm biased by the spring and at a free end of the arm is provided a wheel. Furthermore, there are at least two principal guiding members 304 which may be in the form of a rounded projections from the vehicle body 301 or, as in the preferred embodiment, wheels. These principal guiding members 304 are provided on the front portion 301A of the vehicle body 301. They are angularly displaced from the driving wheel 302 and the presser 303 for maintaining the driving wheel substantially in the central plane X when the toy vehicle 300 moves along the toy track system 100.

To assist the maintenance of the driving wheel 302 substantially in the central plane X, there is provided at least three and preferably four auxiliary guiding members 305 provided on the rear portion 301B of the vehicle body. These auxiliary guiding members 305 are angularly evenly spaced. The auxiliary guiding members 305 are angularly displaced from the principal guiding members 304 and are preferably angularly displaced from the driving wheel 302 and presser 303 for maintaining the driving wheel 302 substantially in the central plane X when the toy vehicle 300 moves along the toy track system 100. When there are four auxiliary guiding members 305, each of them is preferably provided on different planes. These planes are at 90 degree relative to one another.

In the preferred embodiment, the principal guiding members 304 are arranged opposite one another on the vehicle body 301. They can collaborate to act on the inner surface of the toy track system 100, as left and right guides. The plane on which these principal guiding members 304 are arranged is preferably perpendicular to that of the driving wheel 302 and the presser 303. In other words, the auxiliary guiding members 304, the driving wheel 302 and the presser 303 are angularly evenly spaced from one another. This forms four points of possible contacts with the inner surface of the toy track system 100. The distance between a) the uppermost of the presser 303, when relaxed, i.e. when the spring is at a preferred default state, and b) the lowermost of the driving wheel 302 is longer than diameter of a given the tube section 101. This allow the presser 303 always bear on the inner surface of the tube sections 101 and force the driving wheel 301 to remain in frictional contact with the inner surface of the tube sections 101. This ensures the propelling of the toy vehicle 300 in the toy track system 100.

When viewed from one end of the toy vehicle 300, the driving wheel 302, the presser 303, the principal and auxiliary guiding members 304 and 305 forms a "✳" pattern.

The principal and auxiliary guiding members 304 and 305 are preferably wheels or they may be rounded surfaces or rotors in a socket. Wheels are preferred because these wheels are allowed certain degree of wobbling. In other word, the wheels may pivot on the wheel shaft. This permits certain degree of self-adjustment along the toy track system 100 when the toy vehicle is making a turn to ensure the driving wheel 302 is maintained on the plane X.

The auxiliary guiding members 304 are radially displaced from the driving wheel 302, the presser 303 and preferably the principal guiding members 304. This permits the toy vehicle 300 to negotiate turns in the toy track system 100.

The toy vehicle is powered by a battery, preferably a rechargeable battery such that it is self-propelling. Preferably lights may be placed on the vehicle body 301 to illuminate the toy vehicle 300 when the toy vehicle 300 travels through the toy track system 100 in a dark environment. To this end, the tube sessions should be transparent if not translucent.

The toy track system 100 and one or more toy vehicle 300 may be sold in a toy kit.

The invention has been given by way of example only, and various other modifications of and/or alterations to the described embodiment may be made by persons skilled in the art without departing from the scope of the invention as specified in the appended claims.

The invention claimed is:

1. A toy track system for a toy car to move therein and along, comprising: a plurality of tube sections including at least first and second tube sections which are connectable endwise together to form part of the toy track system; and a connection module comprising: coupling means having first and second coupling parts which are provided on the first and second tube sections respectively and are inter-engageable with each other to prevent axial separation between the first and second tube sections; and interlocking means having first and second interlocking parts which are provided on the first and second tube sections respectively and are inter-engageable with each other to fix the first and second tube sections in one predetermined angular position relative to each other selected from at least two predetermined angular positions, wherein the connection module includes first and second sleeves on which any of the first and second coupling parts are supported respectively, wherein the first and second sleeves are provided at one end of the first and second tube sections respectively at which they are connectable endwise, wherein the first sleeve is insertable into the second sleeve for inter-engagement of the first and second coupling parts to prevent axial separation between the first and second tube sections, and wherein the coupling means includes a flexing member on one of the first and second sleeve for assisting insertion of the first sleeve into the second sleeve.

2. The toy track system as claimed in claim 1, wherein the flexing member comprises a pair of separated plates.

3. The toy track system as claimed in claim 2, wherein the plates are separated by a slot or a slit.

4. A toy track system for a toy car to move therein and along, comprising: a plurality of tube sections including at least first and second tube sections which are connectable endwise together to form part of the toy track system; and a connection module comprising: coupling means having first and second coupling parts which are provided on the first and second tube sections respectively and are inter-engageable with each other to prevent axial separation between the first and second tube sections; and interlocking means having first and second interlocking parts which are provided on the first and second tube sections respectively and are inter-engageable with each other to fix the first and second tube sections in one predetermined angular position relative to each other selected from at least two predetermined angular positions, wherein the connection module includes first and second sleeves on which any of the first and second coupling parts are supported respectively, and wherein the connection module includes a third sleeve on which there is provided corresponding first and second coupling parts for inter-engaging the first and second coupling parts on the first and second sleeve.

5. The toy track system as claimed in claim 4, wherein the coupling means includes a flexing member on the first and second or the third sleeve for assisting inter-engagement of corresponding first and second coupling parts.

6. The toy track system as claimed in claim 4 wherein, the first and second sleeves are insertable into the third sleeve for inter-engagement of the first and second coupling parts.

7. The toy track system as claimed in claim 6, wherein the coupling means includes a flexing member on the third sleeve for assisting insertion of the first and second sleeve into the third sleeve.

8. A toy track system for a toy car to move therein and along, comprising: a plurality of tube sections including at least first and second tube sections which are connectable endwise together to form part of the toy track system; and a connection module comprising: coupling means having first and second coupling parts which are provided on the first and second tube sections respectively and are inter-engageable with each other to prevent axial separation between the first and second tube sections; and interlocking means having first and second interlocking parts which are provided on the first and second tube sections respectively and are inter-engageable with each other to fix the first and second tube sections in one predetermined angular position relative to each other selected from at least two predetermined angular positions, wherein the first coupling part has a first surface operable to abut a first surface of the second coupling part when the first and second coupling parts inter-engage to thereby prevent the axial separation between the first and second tube sections, and wherein the first coupling part has a second surface operable to abut a second surface of the second coupling part, the second surfaces form the first and second interlocking parts of the interlocking means to fix the first and second tube sections in one predetermined angular position relative to each other selected from at least two predetermined angular positions.

9. The toy track system as claimed in claim 8, wherein the first and second surfaces are arranged orthogonal to one another.

10. A toy vehicle for moving in and along a toy track system having a longitudinal central plane including a longitudinal central axis, comprising: a vehicle body having opposite first and second end portions and opposite first and second sides; a driving wheel provided at the first end portion on the first side of the vehicle body for frictional engagement with an inner surface of said track system to move the vehicle body; an electric motor provided in the vehicle body for rotating the driving wheel; gears provided in the vehicle body for transmitting drive from the electric motor to the driving wheel for rotating the driving wheel; a presser mounted at the first end portion on the second side of the vehicle body and resiliently biased in a direction directly opposite and away from the driving wheel for bearing against said inner surface to maintain said frictional engagement of the driving wheel; at least two principal guiding members provided on the first end portion of the vehicle body, the principal guiding members being angular displaced from the driving wheel and the presser for maintaining the driving wheel substantially in a said central plane when the toy vehicle moves along the toy track system; and at least three auxiliary guiding members provided on the second end portion of the vehicle body and angularly displaced from the principal guiding members for maintaining the driving wheel substantially in a said central plane when the toy vehicle moves along the toy track system.

11. The toy vehicle as claimed in claim 10, wherein the principal guiding members are arranged opposite one another.

12. The toy vehicle as claimed in claim 11, wherein the principal guiding members are arranged on a first plane which extends perpendicular to a second plane on which the driving wheel and the presser are arranged.

13. The toy vehicle as claimed in claim 12, wherein the at least three auxiliary guiding member are equally spaced apart from each other and are arranged on respective planes angularly displaced from the first and second planes.

14. The toy vehicle as claimed in claim 12, wherein the second end portion of the vehicle body is provided with four auxiliary guiding members angularly displaced from the principal guiding members for maintaining the driving wheel substantially in a said central plane when the toy vehicle moves along the toy track system.

15. The toy vehicle as claimed in claim 14, wherein the four auxiliary guiding members are arranged on different planes which are arranged substantially perpendicular to one another and are evenly angularly displaced from the first and second planes.

16. The toy vehicle as claimed in claim 10, wherein the auxiliary guiding members are radially displaced from the driving wheel such that the auxiliary guiding members are relatively closer to the vehicle body than the driving wheel.

17. The toy vehicle as claimed in claim 10, wherein the principal and auxiliary guiding members comprise wheels.

18. The toy vehicle as claimed in claim 10, wherein the vehicle body includes a battery mounted therein.

19. The toy vehicle as claimed in claim 18, wherein the battery is a rechargeable battery.

20. A toy track system for a toy car to move therein and along, comprising: a plurality of tube sections including at least first and second tube sections which are connectable endwise together to form part of the toy track system; and a connection module comprising: coupling means having first and second coupling parts which are provided on the first and second tube sections respectively and are inter-engageable with each other to prevent axial separation between the first and second tube sections; and interlocking means having first and second interlocking parts which are provided on the first and second tube sections respectively and are inter-engageable with each other to fix the first and second tube sections in one predetermined angular position relative to each other selected from at least two predetermined angular positions and a toy vehicle for moving in and along the toy track system having a longitudinal central plane including a longitudinal central axis, the toy vehicle comprising: a vehicle body having opposite first and second end portions and opposite first and second sides; a driving wheel provided at the first end portion on the first side of the vehicle body for frictional engagement with an inner surface of said track system to move the vehicle body; an electric motor provided in the vehicle body for rotating the driving wheel; gears provided in the vehicle body for transmitting drive from the electric motor to the driving wheel for rotating the driving wheel; a presser mounted at the first end portion on the second side of the vehicle body and resiliently biased in a direction directly opposite and away from the driving wheel for bearing against said inner surface to maintain said frictional engagement of the driving wheel; at least two principal guiding members provided on the first end portion of the vehicle body, the principal guiding members being angular displaced from the driving wheel and the presser for maintaining the driving wheel substantially in a said central plane when the toy vehicle moves along the toy track system; and at least three auxiliary guiding members provided on the second end portion of the vehicle body and angularly displaced from the principal guiding members for maintaining the driving wheel substantially in a said central plane when the toy vehicle moves along the toy track system.

* * * * *